US011097929B2

(12) United States Patent
Holen et al.

(10) Patent No.: US 11,097,929 B2
(45) Date of Patent: Aug. 24, 2021

(54) TOP-MOUNTED HOIST FOR USE IN A DERRICK OR DRILLING MAST OF AN OIL AND GAS RIG

(71) Applicant: Cameron International Corporation, Houston, TX (US)

(72) Inventors: Dag Holen, Kristiansand (NO); Erling Tambs, Kristiansand (NO); Rolf Gullaksen, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 198 days.

(21) Appl. No.: 16/298,930

(22) Filed: Mar. 11, 2019

(65) Prior Publication Data

US 2020/0290850 A1 Sep. 17, 2020

(51) Int. Cl.

| | |
|---|---|
| ***B66D 1/80*** | (2006.01) |
| ***B66D 1/82*** | (2006.01) |
| ***B66D 1/02*** | (2006.01) |
| ***E21B 19/084*** | (2006.01) |
| ***E21B 19/02*** | (2006.01) |
| ***E21B 19/00*** | (2006.01) |

(52) U.S. Cl.

CPC ..... *B66D 1/82* (2013.01); *B66D 1/02* (2013.01); *E21B 19/006* (2013.01); *E21B 19/02* (2013.01); *E21B 19/084* (2013.01)

(58) Field of Classification Search

CPC ... B66D 1/08; B66D 1/22; B66D 1/24; B66D 1/82; E21B 19/02; E21B 19/084; E21B 3/022

See application file for complete search history.

(56) References Cited

U.S. PATENT DOCUMENTS

| | | | | | |
|---|---|---|---|---|---|
| 4,393,944 | A * | 7/1983 | Gugger | E21B 7/027 | 173/28 |
| 4,872,517 | A * | 10/1989 | Shaw | E21B 19/02 | 173/218 |
| 5,107,940 | A * | 4/1992 | Berry | E21B 7/023 | 175/122 |
| 6,056,060 | A * | 5/2000 | Abrahamsen | B66C 13/04 | 166/380 |
| 2005/0077049 | A1* | 4/2005 | Moe | E21B 19/006 | 166/355 |
| 2016/0060976 | A1* | 3/2016 | Plain | E21B 19/006 | 166/355 |

(Continued)

*Primary Examiner* — Emmanuel M Marcelo
(74) *Attorney, Agent, or Firm* — Jeffrey D. Frantz

(57) ABSTRACT

Embodiments of a top-mounted hoisting system include a single-layer winch drum located at an uppermost end of a derrick or drilling mast, a drill string handling tool, and one or more drill lines extending from the single layer winch drum to the drill string handling tool. The drill string handling tool may be a top drive. When the drill line is connected directly to the lifted load, the drill line experiences far less load cycles than when the line runs through crown and travelling blocks. If the drum diameter is large enough, cut-and-slip operations may be eliminated, and the drill line may be replaced at longer time intervals. Embodiments provide for lower weight and may provide lower cost as a result. The top-mounted drum does not take up any space on the drill floor and less total length of drill line is also required than if the drum was floor-mounted.

13 Claims, 3 Drawing Sheets

(56) References Cited

U.S. PATENT DOCUMENTS

| | | | | |
|---|---|---|---|---|
| 2016/0060977 | A1* | 3/2016 | Plain | E21B 17/20<br>166/355 |
| 2016/0137466 | A1 | 5/2016 | Eriksson et al. | |
| 2018/0305982 | A1* | 10/2018 | Aas | E21B 3/02 |
| 2018/0313173 | A1* | 11/2018 | McBeath | E21B 19/002 |
| 2019/0071938 | A1* | 3/2019 | Taraldrud | E21B 19/006 |

* cited by examiner

TOP-MOUNTED HOIST FOR USE IN A DERRICK OR DRILLING MAST OF AN OIL AND GAS RIG

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates to drawworks used in a derrick or a drilling mast of an oil or gas drilling rig. More particularly, the disclosure relates to the drawworks winch and winch drum, and how these are connected to the lifted load.

The drawworks of an oil or gas drilling rig typically includes a large-diameter steel spool or winch drum, brakes, a power source, and assorted auxiliary devices. The primary function of the drawworks is to reel out and reel in the drill line in a controlled fashion. The drill line may be a ¾ inch to 2¼ inch (19 mm to 57 mm) diameter, multi-thread, twisted wire rope. The wire rope may include a polymer or plastic insert. The drill line spooled on the winch drum is reeled over a hoist that includes a plurality of sheaves to gain mechanical advantage in a block-and-tackle or pulley fashion. The sheaves may be located in a crown block located toward a top end of the drilling mast and in a traveling block located below the crown block. This reeling out and in of the drill line causes the traveling block, and whatever may be hanging underneath it, to be lowered into or raised out of the wellbore. The reeling out of the drill line may be powered by gravity and reeling in may be powered by an electric or hydraulic motor or a diesel engine connected to the winch drum As a precaution against drill line failure due to fatigue, the work done by the drill line is closely monitored and limited. The work is commonly measured as the cumulative product of the load lifted (e.g., in tons) and the distance lifted or lowered (e.g., in miles). After a predetermined limit of ton-miles, slip-and-cut operations are performed. New drill line is unspooled from a storage reel and slipped through the crown block and traveling block sheaves and the winch drum, with the excess on the drum end cut off and discarded. Slip-and-cut operations can become more difficult as drill line diameter increases and can be very difficult at or above 2¼ inch (57 mm) drill line. As load lifting requirements increase—for example, greater than 1250 tons to 1500 tons or more—drill line could increase above 2¼ inch.

The winch drum is drill- or rig-floor mounted, taking up valuable space on the floor. When floor-mounted, the mast must typically support additional loads from the drill line running from the drawworks to the mast top (fast line) and the dead end running back down to the dead line anchor. Additionally, the winch drum usually includes multiple layers of drill line wrapped about it. The overlying layers of drill line place significant force on the underlying layers when under load, further increasing wear and tear. Further, in order to lift the load, the drill line runs through the crown and travelling blocks through a number of sheaves, typically 8-16 times faster than the lifted load, leading to a short drill line fatigue life. US 2016/0137466 A1 to Eriksson (National Oilwell Varco Norway AS) attempts to reduce the wear-and-tear problem by providing a single-layer, helical grooved, winch drum. A single-layer drum can deliver constant line speed. When the single layer winch is connected directly to the lifted load, wire tension is also the same as the lifted load. So, due to this, we may need several drill lines in parallel to take the load. When the drill line is connected directly to the load, it will go through much less load cycles, and with a large drum, the fatigue life of the drill line can be several years, even with intense use. However, the prior art single-layer winch is still floor-mounted below the hoist or sheaves. When the single layer winch is floor mounted, the derrick or mast must resist two times the hook load.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

Embodiments of a top-mounted hoisting system of this disclosure comprise a drawworks winch including a single-layer winch drum located at an uppermost end of a derrick or drilling mast, a drill string handling tool, and one or more drill lines extending from the single layer winch drum to the drill string handling tool, wraps of each drill line about the drum being on the same level as the wraps of the other drill lines. The drum may include electric or hydraulic motors. In some embodiments, the drill string handling tool may be a top drive. The one or more drill lines may be connected to a guide dolly containing the top drive. In embodiments in which two or more drill lines extend from the winch drum, the top-mounted hoisting system includes equalizers configured to equalize line pull.

Figure 1:
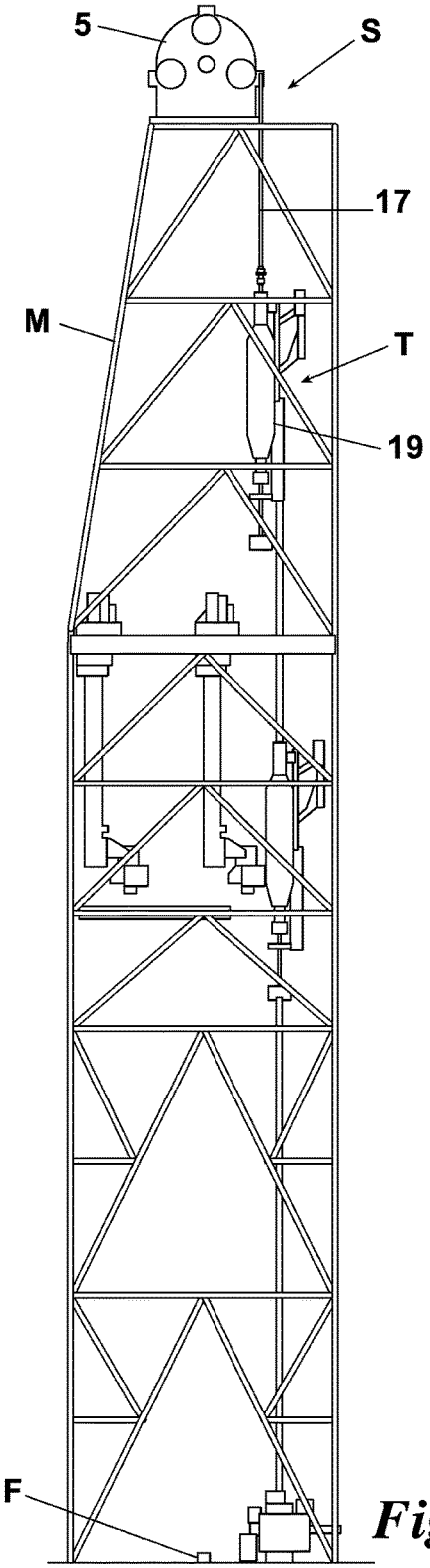
FIG. 1 is a side elevation view of a derrick or drilling mast including an embodiment of a top-mounted hoisting system of this disclosure.
Figure 2:
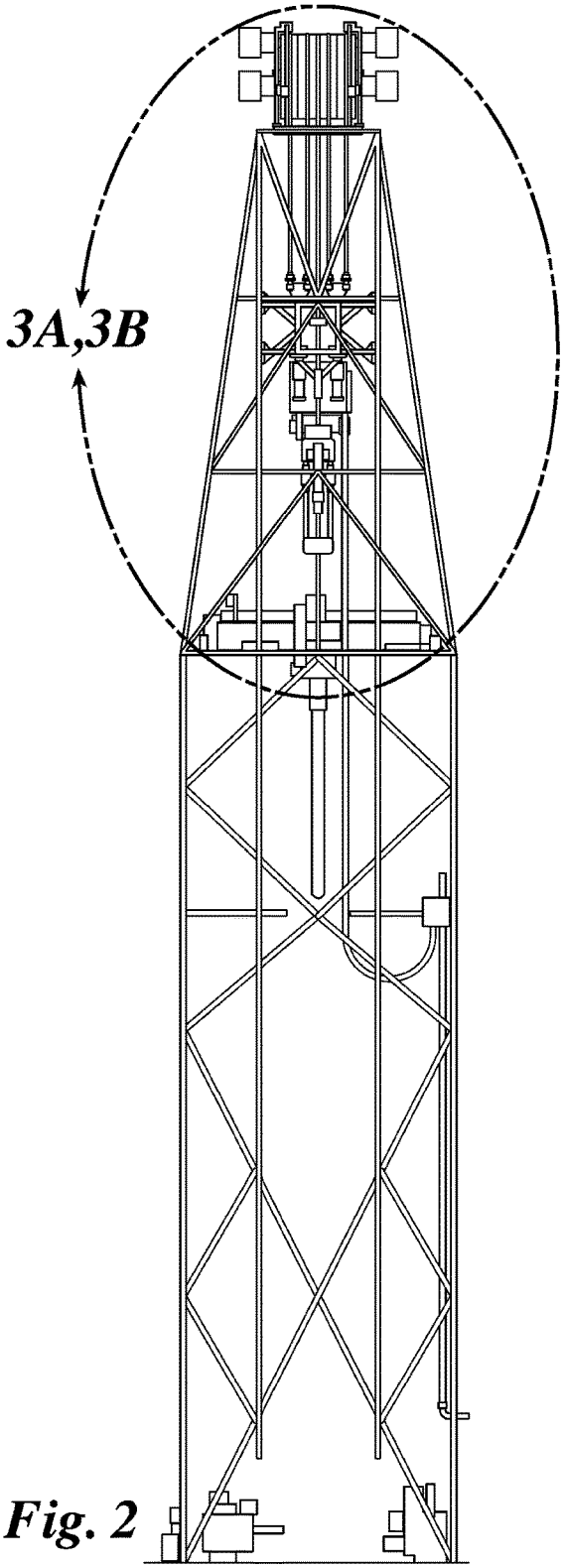
FIG. 2 is a side elevation view of the top-mounted hoist of FIG. 1.
Figure 3A:
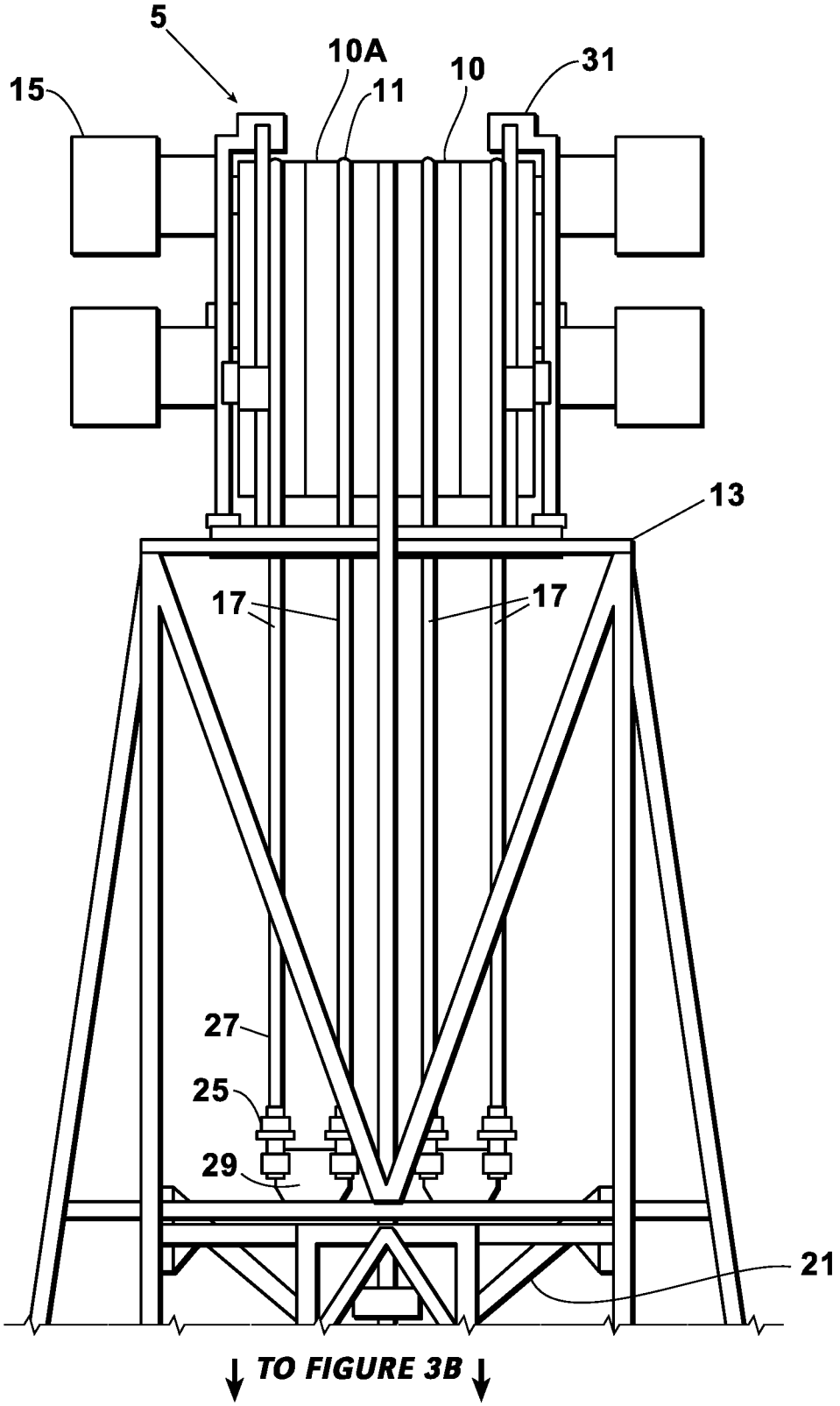
FIGS. 3A and 3B are enlarged views of section 3 of FIG. 2.
Figure 3B:
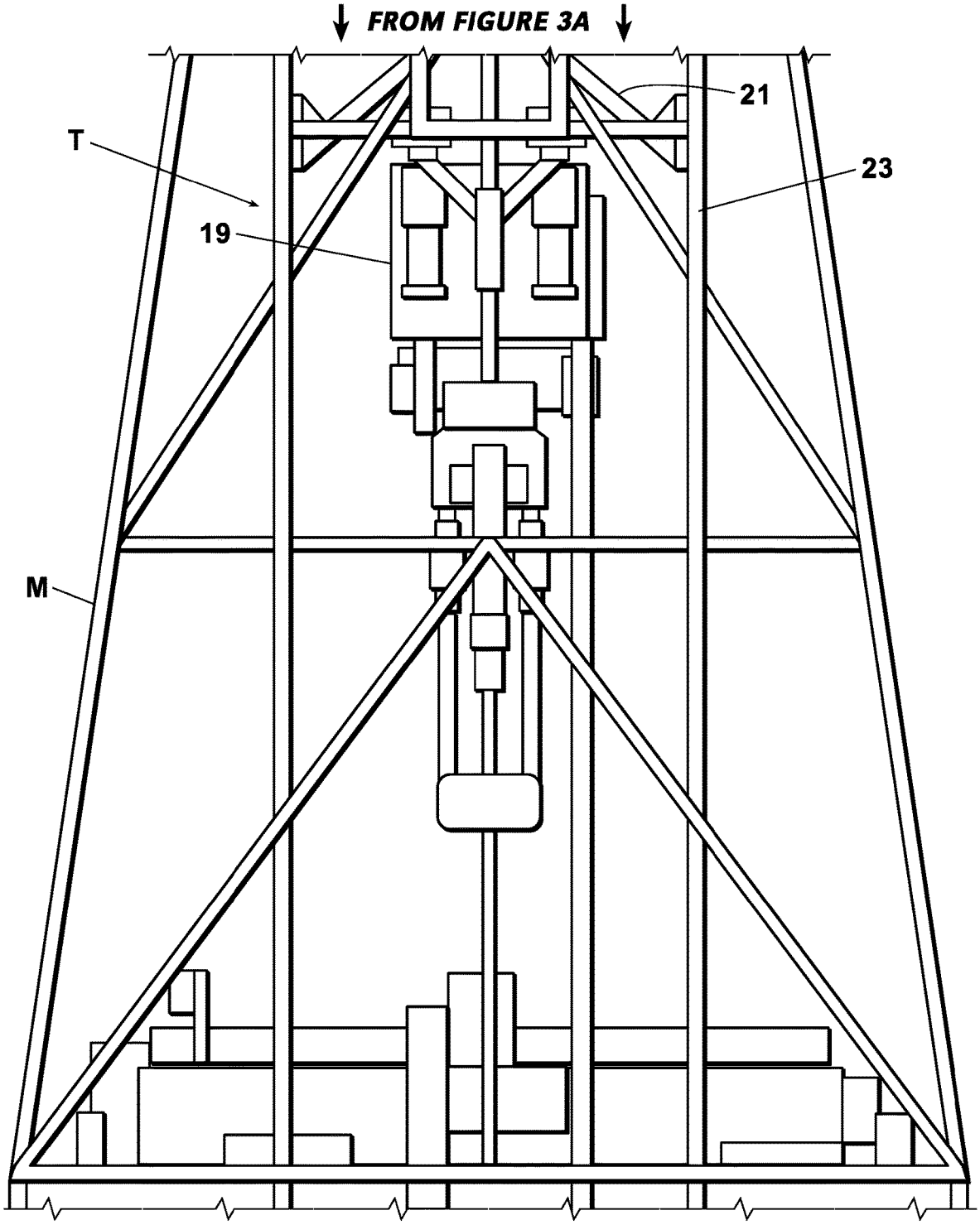

The subject disclosure is further described in the following detailed description, and the accompanying drawing and schematic of non-limiting embodiment of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring to the drawings, embodiments of a top-mounted hoisting system S of this disclosure include a drawworks 5 having a single-layer winch drum 10 containing a wire rope 11 and mounted toward or at the uppermost end 13 of a derrick or drilling mast M. Because the drum is single layer, each wrap of the rope 11 about the drum 10 is at the same level as all other wraps of the rope about the drum 10. The winch drum 10 may be powered by a plurality of motors 15 connected to gears 31. Gears 31 may include a gearbox connected to an internal tooth ring on each side of the drum. The winch drum 10 may include spaced apart sections 10A, each section 10A containing wire rope 11. The wire rope 11 may provide one or more drill lines 17 that extend downward from the drum 10 to support a drill string handling tool T configured to rotate a drill string. For example, a first drill line 17 may be wrapped in a single layer about one section 10A of the drum 10 and a second drill line 17 may be wrapped about another different section 10A of the drum 10. An end 27 of the drill line 17 is directly connected to the drill string handling tool T. Clamps or anchors 29 may be used to connect the end 27 to the tool T.

In embodiments, the drill string handling tool T may be a top drive 19. The top drive 19 may be connected to a guide dolly 21 that rides along a vertically oriented dolly track 23 running a length of the mast M. As the drill line 17 is reeved in and out, dolly 21 (and therefore top drive 19) is moved up and down. The top drive 19 may include of one or more electric or hydraulic motors connected with appropriate gearing to a short section of pipe called a quill, that in turn may be screwed into a saver sub or the drill string itself.

The number of drill lines 17 for a given application depends, in part, on wire diameter and may be determined using means known in the art. Regardless of the number of lines 17, this top-mounted, single-layer configuration provides longer life for the drill line without the need for slip-and-cut operations. Because of the single-layer, line hoisting may be accomplished with electric motors or hydraulic motors 15. Where multiple drill lines 17 extend downward from the drum 10, line equalizers 25 of a kind known in the art may be connected toward or at an end 27 of the lines 17.

Because the drum 10 is mounted above the drill string handling tool T, toward or at the uppermost end 13 of the derrick or drilling mast M, the mast M must only support the weight of the drum 10 and the hook load, the hook load typically being orders of magnitude above the weight of the drum 10. In order to achieve this, a larger diameter drum 10 should be used in connection with the single layer. By way of a non-limiting example, in some embodiments the derrick is 160 ft high, the drill string handling tool is 20 ft. long and supported by four 2½ in. lines 17. The drum may have a diameter of approximately 3000 mm to 4000 mm and a length from 1600 mm to 2000 mm to allow for this travel. As persons skilled in the art would recognize, drum size strongly depends on what wire solutions are selected for a given application. For example, the drum must be large enough to allow full travel of the top drive, but the drum length will depend on how the drill line is connected in the dead end, the number of dead wraps, and the amount of separation between each line in a multi-line configuration. If a single-layer winch drum 10 was located on the drill floor F, the demand placed on the mast M would be at least twice the hook load. Therefore, embodiments of this disclosure provide for lower weight, and may provide lower cost as a result, compared to prior art systems. Additionally, the top-mounted drum 10 does not take up any space on the drill floor F. Less total length of drill line is also required than if the drum was located on the drill floor.

Embodiments of a method of this disclosure include supporting a drill string handling tool T by at least one drill line 17 wrapped about a single-layer winch drum 10 located at an uppermost end 13 of a derrick or drilling mast M, one end 27 of the at least one drill line 17 connected to the drill string handling tool T, all wraps of the at least one drill line 17 being on a same level. For example, a first drill line 17 may be wrapped in a single layer about one section 10A of the drum 10 and a second drill line 17 may be wrapped about another different section 10A of the drum 10, the lines 17 being a single layer wrap and having an end 27 connected to the drill string handling tool T. The method may include actuating the single-layer winch drum 10 to vertically raise or lower the drill string handling tool T. The method may also include mounting the single-layer winch drum 10 to the uppermost end 13 of the derrick or drilling mast M and connecting the end 27 of the drill line 17 to the drill string handing tool T. The maximum load supported by the derrick or drilling mast M during rotation of the drill string is the weight of the drum plus the hook load. The method (and system) may operate with very high efficiency due to very little loss due to reeving and inertia.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A top-mounted hoisting system for use in a derrick or drilling mast, the top-mounted hoisting system comprising:

a single-layer winch drum located at an uppermost end of the derrick or drilling mast;

a first drill line wrapped about a section of the single-layer winch drum, all wraps of the first drill line being on a same level;

a drill string handling tool located below the single-layer winch drum;

an end of the first drill line connected to the drill string handling tool; and a second drill line wrapped about another section of the single-layer winch drum and having an end connected to the drill string handling tool, all wraps of the second drill line being on a same level, wherein the first and second drill lines each include a line equalizer located toward a respective connected end.

2. The top-mounted hoisting system of claim 1, wherein the drill string handling tool is configured to rotate a drill string.

3. The top-mounted hoisting system of claim 1, further comprising:

the drill string handling tool including a top drive.

4. The top-mounted hoisting system of claim 3, further comprising:

the top drive including a guide dolly configured for vertical displacement along the derrick or drilling mast.

5. The top-mounted hoisting system of claim 1, further comprising:

the single-layer winch drum including at least one electric motor or hydraulic motor.

6. A top-mounted hoisting system comprising:

a single-layer winch drum located at an uppermost end of a derrick or drilling mast;

a first drill line wrapped about the single-layer winch drum, all wraps of the first drill line being on a same level;

a top drive located below the single-layer winch drum;

an end of the first drill line connected to the top drive; and a second drill line wrapped about another section of the single-layer winch drum and having an end connected to a drill string handling tool, all wraps of the second drill line being on a same level, wherein the first and second drill lines each include a line equalizer located toward a respective connected end.

7. The top-mounted hoisting system of claim 6, further comprising:

the top drive including a guide dolly configured for vertical displacement along the derrick or drilling mast.

8. The top-mounted hoisting system of claim 6, further comprising:

the single-layer winch drum including at least one electric motor or hydraulic motor.

9. A method of handling a drill string, the method comprising:

supporting a drill string handling tool by a first drill line and a second drill line each wrapped about a single-layer winch drum located at an uppermost end of a derrick or drilling mast, wherein respective ends of the first drill line and the second drill line are connected to the drill string handling tool, wherein all wraps of the first drill line and the second drill line are on a same level, and wherein the first and second drill lines each include a line equalizer located toward the respective connected end.

10. The method of claim 9, further comprising:

actuating the single-layer winch drum to vertically raise or lower the drill string handling tool.

11. The method of claim 9, wherein the drill string handling tool is configured to rotate the drill string.

12. The method of claim 9, wherein the drill string handling tool includes a top drive.

13. The method of claim 9, further comprising:

mounting the single-layer winch drum to the uppermost end of the derrick or drilling mast.

* * * * *